US005380616A

United States Patent [19]

Aoki et al.

[11] Patent Number: 5,380,616

[45] Date of Patent: Jan. 10, 1995

[54] TONER FOR DEVELOPING LATENT ELECTROSTATIC IMAGES

[75] Inventors: Mitsuo Aoki; Yoshihiro Suguro; Tomio Kondo; Yasushi Nakamura; Satoru Miyamoto, all of Numazu, Japan

[73] Assignee: Ricoh Company, Ltd., Tokyo, Japan

[21] Appl. No.: 983,893

[22] Filed: Dec. 1, 1992

[30] Foreign Application Priority Data

Dec. 6, 1991 [JP] Japan ..... 3-349018

[51] Int. Cl.[6] ..... G03G 9/097

[52] U.S. Cl. ..... 430/110

[58] Field of Search ..... 430/106, 109, 110

[56] References Cited

U.S. PATENT DOCUMENTS 4,528,257 7/1985 Polderman et al. ..... 430/109

4,664,841 5/1987 Kitahara et al. ..... 430/116

*Primary Examiner*—John Goodrow

*Attorney, Agent, or Firm*—Cooper & Dunham

[57] ABSTRACT

A toner for developing latent electrostatic images composed of a continuous phase containing a binder resin, and a disperse phase dispersed in the form of finely-divided disperse phases in the continuous phase, containing a resin which is not the same as the binder resin for use in the continuous phase, and finely-divided particles of a releasing agent which are dispersed in the resin, with a coloring agent being dispersed in the continuous phase and/or the disperse phase.

20 Claims, No Drawings

TONER FOR DEVELOPING LATENT ELECTROSTATIC IMAGES

BACKGROUND OF THE INVENTION

1. Field of the Invention

The present invention relates to a toner for developing latent electrostatic images for use in the fields of electrophotography, electrostatic recording and electrostatic printing.

2. Discussion of Background

Generally, in accordance with various kinds of method, latent electrostatic images are formed on a photoconductor using a photoconductive material contained in the photoconductor in the electrophotographic process. The latent electrostatic images thus formed on the photoconductor are developed into visible images with a toner. The visible toner images thus formed are transferred onto an image-receiving material such as a sheet of paper when necessary, and fixed thereon by heating or by applying a solvent vapor, so that the making of a print can be attained. For developing the latent electrostatic images formed on the photoconductor into visible toner images, various developing procedures such as magnetic brush development, cascade development, and powder cloud development are conventionally known. In any development procedure, it is an important step to fix visible toner images onto the image-receiving material.

In the case where the toner images are fixed onto the image-receiving material by using a heat-application roller, which is the most widely-used image fixing means, the heat-application roller is in contact with a toner in a fused state at the image fixing step. As a result, the fused toner partially sticks to the surface of the heat-application roller and the image-receiving material subsequently sent to the heat-application roller is stained with the fused toner, namely, a so-called off-set phenomenon occurs.

There is proposed in Japanese Laid-Open Patent Application 54-114245 a toner capable of attaining image fixing performance at a low temperature, and at the same time, preventing the off-set phenomenon. This toner comprises a low-molecular-weight polyester resin or epoxy resin which can be fused at low temperatures, in an amount of 50 to 95 parts by weight, and a giant-molecular-weight vinyl resin with a weight-average molecular weight of 500,000 or more. However, since there is a big difference in melting viscosity between the aforementioned polyester resin or epoxy resin and vinyl resin, they cannot be highly dispersed even when kneaded under the application of heat thereto with a strong shearing force applied thereto for a long period of time in the course of preparing the toner.

In general, in the case where resins having poor compatibility with each other are mixed together, a continuous phase and a disperse phase are generated in the obtained mixture as described in Plastic, 13, No. 9, 1P (1962). The dispersion properties of the resin mixture can be improved by making each of the finely-divided disperse phases dispersed in the continuous phase small. It is considered that the closer the melting viscosities of resins to be mixed together, the better the dispersion properties of the obtained resin mixture when the resins are kneaded under the application of heat thereto. When the toner obtained in the previously mentioned Japanese Laid-Open Patent Application 54-114245 is observed with a transmission-type electron microscope, a disperse phase comprising styrene—butadiene resin is present in the form of fairly large particles in a continuous phase comprising polyester, and further, carbon black particles serving as a coloring agent are not uniformly dispersed in the toner particle. In addition, when this toner is mixed with a carrier of iron powder to prepare a two-component type developer, the distribution of the charge quantity of the toner is considerably widened, and fogging is caused after copying is repeatedly carried out.

Moreover, in the case where a releasing agent is contained in a toner to prevent the off-set phenomenon, the compatibility of the releasing agent with the binder resins generally used in the toner is considerably poor since the molecular weight of the releasing agent is extremely low. Consequently, the releasing agent is dispersed in the form of large particles in a toner particle. Thereafter, the releasing agent bleeds out toward the surface of the toner particle with the application of heat thereto when the toner particles are stirred and come into collision in a development unit. Thus, the releasing agent on the surface of the toner particle adheres to the surface of a carrier particle or a charge-application member provided in the development unit, such as a sleeve. Due to the adhesion of the toner to the carrier, namely, a so-called spent phenomenon, the durability of the obtained developer remarkably deteriorates.

As previously mentioned, there has not been proposed a toner with high durability, capable of carrying out image fixing performance at a low temperature without causing the off-set phenomenon and forming a toner image which does not adhere to a vinyl chloride product.

SUMMARY OF THE INVENTION

Accordingly, an object of the present invention is to provide a toner for developing latent electrostatic images, with high durability, capable of carrying out excellent image fixing performance at a low temperature, and at the same time, causing no off-set phenomenon.

Another object of the present invention is to provide a toner for developing latent electrostatic images, capable of forming toner images which do not adhere to a vinyl chloride product.

The above-mentioned objects of the present invention can be achieved by a toner for developing latent electrostatic images, comprising toner particles, each of the toner particles composed of a continuous phase comprising a binder resin, and a disperse phase dispersed in the form of finely-divided disperse phases in the continuous phase, comprising a resin which is not the same as the above-mentioned binder resin for use in the continuous phase, and finely-divided particles of a releasing agent which are dispersed in the resin, with a coloring agent being dispersed in the continuous phase and/or the disperse phase.

DESCRIPTION OF THE PREFERRED EMBODIMENTS

In the present invention, specific examples of the resin in the disperse phase are a styrene-acrylic acid ester copolymer, a styrene-methacrylic acid ester copolymer, and a polyester resin. Of these resins, the styrene-acrylic acid ester copolymer and styrene-methacrylic acid ester copolymer are preferable.

Examples of the binder resin (hereinafter referred to as a binder resin A) in the continuous phase are a styrene-acrylic acid ester copolymer, a styrene-methacrylic acid ester copolymer, and a polyester resin. In this case, the polyester resin is preferable. The kind of resin in the disperse phase is not the same as that of the binder resin A in the continuous phase. Therefore, it is preferable that a styrene-acrylic acid ester copolymer or styrene-methacrylic acid ester copolymer be used as the resin in the disperse phase and a polyester resin be used as the binder resin A in the continuous phase, or that a polyester resin be used as the resin in the disperse phase and a styrene-acrylic acid ester copolymer or styrene-methacrylic acid ester copolymer be used as the binder resin A in the continuous phase.

In the case where a toner comprises as the binder resin component a mixture of a polyester resin and a styrene-acryl-based copolymer which is conventionally used as a binder resin for use in the toner, the image fixing temperature can be decreased. This is because the compatibility of the polyester resin with the styrene-acryl-based copolymer is poor, and therefore, the obtained resin mixture is composed of a continuous phase and a disperse phase which is dispersed in the form of finely-divided disperse phases in the continuous phase. The size of each of the finely-divided disperse phases is an important factor in determining the characteristics of the obtained toner.

In the present invention, the disperse phase is dispersed in the form of finely-divided disperse phases in the continuous phase. It is preferable that the average volume of each of the finely-divided disperse phases dispersed in the continuous phase be in the range of 2 to 800 $\mu m^3$. In this case, the desired releasing effect of the releasing agent contained in the disperse phase can be brought about, and therefore, the spent phenomenon can be prevented to improve the durability of the obtained developer because the size of particles of a releasing agent dispersed in the disperse phase is appropriate, and the image fixing performance at a low temperature can be achieved.

The polyester resin for use in the continuous phase or disperse phase comprises a bivalent alcohol as shown in the following Group I and a dibasic acid as shown in the following Group II. Furthermore, an alcohol or carboxylic acid with three or more valences as shown in the following Group III may be added to the above components as a third component. In addition, it is preferable that 5 to 50 parts by weight of the polyester resin be contained in 100 parts by weight of the toner of the present invention.

Group I (bivalent alcohol): ethylene glycol, triethylene glycol, 1,2-propylene glycol, 1,3-propylene glycol, 1,4-butanediol, neopentyl glycol, 1,4-butenediol, 1,4-bis(hydroxymethyl)cyclohexane, bisphenol A, hydrogenated bisphenol A, a reaction product of polyoxyethylene and bisphenol A, polyoxypropylene(2,2)-2,2-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, and polyoxypropylene(2,0)-polyoxyethylene(2,0)-2,2-bis(4-hydroxy-phenyl)propane.

Group II (dibasic acid): maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, malonic acid, linolenic acid; acid anhydrides of the above acid; and esters of the above acid and a lower alcohol.

Group III (alcohols with three or more valences): glycerol, trimethylol propane, and pentaerythritol; and (carboxylic acids with three or more valences): trimellitic acid and pyromellitic acid.

For the styrene-acrylic acid ester copolymer and styrene-methacrylic acid ester copolymer for use in the continuous phase or disperse phase, examples of the monomer of acrylic acid ester and methacrylic acid ester are methyl acrylate, ethyl acrylate, propyl acrylate, n-butyl acrylate, methyl methacrylate, ethyl methacrylate, propyl methacrylate, n-butyl methacrylate, and t-butyl methacrylate. Of these, styrene-methyl acrylate copolymer is preferably employed in the present invention from the viewpoint of the stain resistance of a vinyl chloride film with the obtained toner.

It is preferable that 20 to 80 parts by weight of the styrene-acrylic acid ester copolymer or styrene-methacrylic acid ester copolymer be contained in 100 parts by weight of the toner.

A releasing agent is dispersed in the form of finely-divided particles in the resin in the disperse phase of the toner particle. A low-molecular-weight polyethylene and polypropylene can be employed as the releasing agent in the present invention. In particular, the low-molecular-weight polypropylene with a number-average molecular weight of 2,000 to 20,000, more preferably 3,000 to 12,000 is preferred in the present invention from the viewpoint of the dispersion properties of the releasing agent in the disperse phase. When the number-average molecular weight of the low-molecular-weight polypropylene is in the aforementioned range, the releasing effect can be obtained to such an extent that the off-set phenomenon is effectively prevented, and at the same time, the industrial production of polypropylene of this type is not difficult.

It is preferable that 0.5 to 30 parts by weight, more preferable 2 to 10 parts by weight of the releasing agent be contained in 100 parts by weight of the toner of the present invention.

In the toner of the present invention, the continuous phase may further comprise a resin (hereinafter referred to as a binder resin B) which is different from the binder resin A.

Specific examples of the binder resin B are as follows: polystyrene, chloropolystyrene, poly $\alpha$-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, homopolymers or copolymers containing styrene or substituted styrene such as styrene-methyl $\alpha$-chloroacrylate copolymer and styrene-acrylonitrile-acrylic acid ester copolymer, vinyl chloride resin, styrene-vinyl acetate copolymer, rosin-modified maleic acid resin, phenolic resin, epoxy resin, ionomer resin, polyurethane resin, silicone resin, ketone resin, ethylene-ethyl acrylate copolymer, xylene resin, and polyvinyl butyral resin.

When the continuous phase comprises the binder resin A and the binder resin B, the same kind of resin as used as the resin in the disperse phase is preferably employed as the binder resin B. For example, when the binder resin A in the continuous phase is a polyester resin and the resin in the disperse phase is a styrene-acrylic acid ester copolymer or styrene-methacrylic acid ester copolymer, it is preferable that the continuous phase further comprise the above-mentioned styrene-acrylic acid ester copolymer or styrene-methacrylic acid ester copolymer as the binder resin B in addition to the polyester resin. In the case where the binder resin A in the continuous phase is a styrene-acrylic acid ester copolymer or styrene-methacrylic acid ester copolymer and the resin in the disperse phase is a polyester resin, the continuous phase may further comprise the above-mentioned polyester resin as the binder resin B.

It is preferable that 50 parts by weight or less of the binder resin B be contained in 100 parts by weight of the toner of the present invention.

The conventionally known pigments or dyes can be employed as a coloring agent in the present invention. The coloring agent is contained in the continuous phase and/or the disperse phase in the toner particle.

Specific examples of the coloring agent for use in the present invention are as follows:

[Black pigments] carbon black, acetylene black, lamp black, and aniline black.

[Yellow pigments] chrome yellow, zinc yellow, cadmium yellow, yellow iron oxide, mineral fast yellow, nickel titanium yellow, naples yellow, Naphthol Yellow S, Hansa Yellow G, Hansa Yellow 10G, Benzidine Yellow G, Benzidine Yellow GR, Quinoline Yellow Lake, Permanent Yellow CG, and Tartrazine Lake.

[Orange pigments] chrome orange, molybdenum orange, Permanent Orange GTR, Pyrazolone Orange, Vulcan Orange, Indanthrene Brilliant Orange RK, Benzidine Orange G, and Indanthrene Brilliant Orange GK.

[Red pigments] red iron oxide, cadmium red, red lead, cadmium mercury sulfide, Permanent Red 4R, lithol red, pyrazolone red, Watchung Red calcium salt, Lake Red D, Brilliant Carmine 6B, Eosine Lake, Rhodamine Lake B, Alizarine Lake, and Brilliant Carmine 3B.

[Violet pigments] manganese violet, Fast Violet B, and Methyl Violet Lake.

[Blue pigments] prussian blue, cobalt blue, Alkali Blue Lake, Victoria Blue Lake, phthalocyanine blue, metal-free phthalocyanine blue, partially-chlorinated phthalocyanine blue, Fast Sky Blue, and Indanthrene Blue BC.

[Green pigments] chrome green, chromium oxide, Pigment Green B, Malachite Green Lake, and Fanal Yellow Green.

[White pigments] zinc flower, titanium oxide, antimony white, and zinc sulfide.

[Loading pigments] barite powder, barium carbonate, clay, silica, white carbon, talc, and alumina white.

[Basic or acid disperse dyes, and direct dyes] nigrosine, methylene blue, Rose Bengale, Quinoline Yellow, and ultramarine blue.

In addition, the continuous phase of the toner particle may further comprise a charge controlling agent to control the polarity and charge quantity of the toner according to the present invention.

Examples of the charge controlling agent are materials with a large polarity such as nigrosine, a monoazo dye, zinc hexadecyl succinate, an alkyl ester or alkyl amide of naphthoic acid, nitrohumic acid, N,N'-tetramethyldiamine benzophenone, N,N'-tetramethylbenzidine, triazine, a salicylic acid metal complex, a quaternary-ammonium-salt-containing copolymer, and an amino-group-containing copolymer. Of these, nigrosine, the quaternary-ammonium-salt-containing copolymer, and the amino-group-containing copolymer are preferable in the present invention.

It is preferable that the quaternary-ammonium-salt-containing copolymer for use in the present invention have structural units (a) and (b) represented by the following general formulas, with (a)-to-(b) ratio of (65:35) to (97:3);

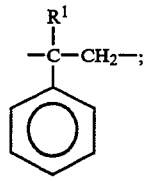

(a)

and

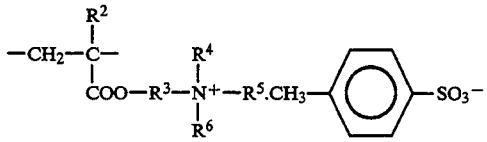

(b)

(wherein $R^1$ and $R^2$ each represent hydrogen or methyl group; $R^3$ represents an alkylene group; and $R^4$, $R^5$ and $R^6$ each represent an alkyl group having 1 to 10 carbon atoms).

Furthermore, the preferable amino-group-containing copolymer used as the charge controlling agent in the present invention is one with a weight-average molecular weight in the range of 2,000 to 10,000, represented by the following general formula (c):

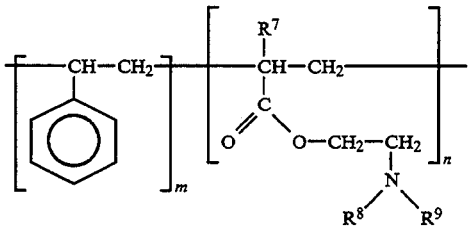

(c)

(wherein $R^7$ represents hydrogen or methyl group; and $R^8$ and $R^9$ each represent an alkyl group having 1 to 10 carbon atoms; and the ratio of m to n is (98:2) to (50:50)).

In the case where the toner of the present invention is employed as a magnetic toner, finely-divided particles of a magnetic material may be dispersed in the continuous phase in the toner particle. As the magnetic material for use in the present invention, any materials conventionally known as the magnetic material for the toner can be employed.

Examples of the magnetic material are iron such as magnetite, hematite, or ferrite; alloys and compounds containing cobalt, nickel, or manganese; and other ferromagnetic alloys.

It is preferable that the average particle diameter of the particle of the above magnetic materials be in the range of approximately 0.1 to 5 μm, more preferably in the range of 0.1 to 1 μm. In addition, it is preferable that the finely-divided particles of the magnetic material be contained in the toner in an amount of approximately 1 to 60 wt. %, more preferably in the range of 5 to 40 wt. % of the total weight of the toner.

Furthermore, to improve the fluidity and cleaning properties of the toner, finely-divided particles of silica, titanium oxide, alumina, silicon carbide, zinc oxide, metallic salts of higher fatty acids, or a regid resin may be dispersed in the continuous phase of the toner particle.

The toner of the present invention can be produced by, for example, dissolving a releasing agent and a binder resin A in an appropriate solvent, with application of heat thereto when necessary, to prepare a solution. Thereafter, monomers constituting a resin for use in the disperse phase were added dropwise to the above obtained solution with stirring to polymerize the resin. After completion of the polymerization, the solvent is removed from the above solution, so that the toner of the present invention can be obtained.

The particle size of the releasing agent dispersed in the disperse phase and the average volume of each of the finely-divided disperse phases in the continuous phase can be controlled by various conditions in the above-mentioned manufacturing process. The average volume of each of the finely-divided disperse phases dispersed in the continuous phase of the toner can be obtained by analyzing a photograph showing cross-sections of toner particles taken by a transmission-type electron microscope or a scanning-type electron microscope.

It is preferable that the volume mean diameter of the toner according to the present invention be approximately 30 μm or less, and more preferably in the range of approximately 4 to 20 μm.

The toner according to the present invention can also be used as a two-component-type developer by mixing with a carrier. In the two-component-type developer, the carrier particles are charged to a polarity opposite to that of the toner particles by friction between the toner particles and the carrier particles.

Other features of this invention will become apparent in the course of the following description of exemplary embodiments, which are given for illustration of the invention and are not intended to be limiting thereof.

EXAMPLE 1

40 parts by weight of a polyester resin (Mw=12,000) and 5 parts by weight of a low-molecular-weight polyethylene (Mw=3,000) serving as a releasing agent were dissolved in toluene at 80° C. to obtain a solution.

With the addition of 2,2'-azobisisobutyronitrile, a mixture of styrene and n-butyl methacrylate at a mixing ratio of (75:25) was stirred at temperatures of 100 to 120° C. in order to obtain 43 parts by weight of a styrene-n-butyl methacrylate copolymer. The previously obtained solution was further added dropwise to the above polymerization mixture and the polymerization was allowed to continue for three hours. Thereafter, a solvent component was removed from the above mixture by heating under vacuum.

Subsequently, 88 parts by weight of the above mixture, 10 parts by weight of carbon black serving as a coloring agent, and 2 parts by weight of nigrosine serving as a charge controlling agent were kneaded under the application of heat thereto in a two-roll mill for one hour, and the mixture thus obtained was pulverized, and then classified, whereby a toner No. 1 with a volume mean diameter of 10 μm according to the present invention was obtained.

The thus obtained toner particle was composed of a continuous phase comprising the styrene-n-butyl methacrylate copolymer, and a disperse phase dispersed in the form of finely-divided disperse phases in the continuous phase, comprising the polyester resin, and finely-divided particles of the low-molecular-weight polyethylene which were dispersed in the polyester resin, with each of the finely-divided disperse phases had an average volume of 500 $\mu m^3$.

4 parts by weight of the toner No. 1 and 96 parts by weight of a commercially available iron oxide carrier "TEFV 200/300" (Trademark), made by Nihon Teppun Co., Ltd., were mixed and stirred using a V-blender for 30 minutes, whereby a two-component-type developer was obtained.

EXAMPLES 2 TO 14

The same procedure for preparation of the toner No. 1 of the present invention as in Example 1 was repeated except that the binder resins and the charge controlling agent for use in the continuous phase, the resin for use in the disperse phase, and the average volume of each of the finely-divided disperse phases were changed as shown in Table 1, so that toners No. 2 to No. 14 according to the present invention were obtained.

Each of the thus obtained toners No. 2 to No. 14 according to the present invention was mixed with the same carrier as employed in Example 1, so that a two-component-type developer was obtained in the same manner as in Example 1.

TABLE 1

| Toner | Disperse Phase (Mw; Parts by weight | Continuous Phase (Mw; Parts by weight) | Average Volume of Each of Finely-divided Disperse Phases ($\mu m^3$) | Releasing Agent (Mn; Parts by weight) |
|---|---|---|---|---|
| Ex. 2 | Polyester resin (20,000; 40) | Styrene - n-butyl methacrylate copolymer (150,000; 43) | 10 | Polyethylene (1,000; 5) |
| Ex. 3 | Polyester resin (20,000; 40) | Styrene - n-butyl methacrylate copolymer (150,000; 43) | 245 | Polyethylene (1,000; 5) |
| Ex. 4 | Polyester resin (20,000; 40) | Styrene - n-butyl methacrylate copolymer (150,000; 43) | 800 | Polyethylene (1,000: 5) |
| Ex. 5 | Styrene - n-butyl methacrylate copolymer (200,000; 40) | Polyester resin (12,000; 43) | 65 | Polyethylene (1,000; 5) |
| Ex. 6 | Styrene - n-butyl methacrylate copolymer (200,000; 40) | Polyester resin (12,000; 43) | 185 | Polypropylene (5,500; 5) |
| Ex. 7 | Styrene - n-butyl | Polyester resin | 180 | Polypropylene |

TABLE 1-continued

| Toner | Disperse Phase (Mw; Parts by weight | Continuous Phase (Mw; Parts by weight) | Average Volume of Each of Finely-divided Disperse Phases ($\mu m^3$) | Releasing Agent (Mn; Parts by weight) |
|---|---|---|---|---|
| | methacrylate copolymer (200,000; 40) | (12,000; 43) | | (25,000; 10) |
| Ex. 8 | Styrene - methyl acrylate copolymer (90,000; 40) | Polyester resin (12,000; 43) | 220 | Polyethylene (1,000; 5) |
| Ex. 9 | Styrene - methyl acrylate copolymer (90,000; 40) | Polyester resin (12,000; 43) | 180 | Polypropylene (5,500; 5) |
| Ex. 10 | Styrene - methyl acrylate copolymer (90,000; 25) | Polyester resin (12,000; 28) and styrene - methyl acrylate copolymer (350,000; 30) | 35 | Polypropylene (5,500; 5) |
| Ex. 11 | Styrene - methyl acrylate copolymer (90,000; 23) | Polyester resin (12,000; 20) and polyester resin (18,000; 40) | 28 | Polypropylene (5,500; 5) |
| Ex. 12 | Styrene - methyl acrylate copolymer (90000; 4) | Polyester resin (12,000; 4) and polyester resin (18,000; 75) | 28 | Polypropylene (5,500; 5) |
| Ex. 13 | Styrene - methyl acrylate copolymer (90,000; 25) | Polyester resin (12,000; 28) and epoxy resin (20,000; 30) | 35 | Polypropylene (5,500; 5) |
| Ex. 14 | Styrene - methyl acrylate copolymer (90,000; 25) | Polyester resin (12,000; 28) and styrene n-butyl methacrylate copolymer (200,000; 30) | 35 | Polypropylene (5,500; 5) |

Comparative Example 1

A mixture of the following components was kneaded under the application of heat thereto in a two-roll mill for one hour.

| | Parts by weight |
|---|---|
| Styrene - n-butyl methacrylate copolymer (Mw = 200,000) | 43 |
| Polyester resin (Mw = 12,000) | 40 |
| Low-molecular-weight polyethylene (Mw = 3,000) | 5 |
| Carbon black | 10 |
| Nigrosine | 2 |

The thus obtained mixture was pulverized and classified, so that a comparative toner No. 1 with a volume mean diameter of 10 $\mu m$ was obtained.

The thus obtained comparative toner No. 1 was mixed with the same carrier as employed in Example 1, so that a two-component-type developer was obtained in the same manner as in Example 1.

EXAMPLE 15

The same procedure for preparation of the toner No. 1 of the present invention as in Example 1 was repeated except that a quaternary-ammonium-salt-containing copolymer having structural units (a) and (b) represented by the following formulas with the respective molar ratios thereof being 1:1:

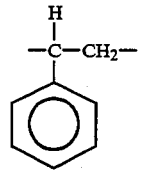

(a)

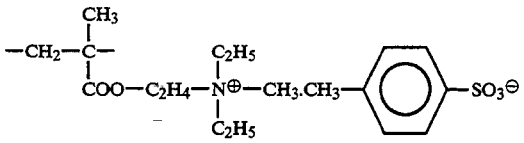

(b)

Thus, a toner No. 15 with a volume mean diameter of 10 $\mu m$ according to the present invention was obtained.

The thus obtained toner No. 15 according to the present invention was mixed with the same carrier as employed in Example 1, so that a two-component-type developer was obtained in the same manner as in Example 1.

EXAMPLES 16 TO 23

The same procedure for preparation of the toner No. 1 of the present invention as in Example 1 was repeated except that the binder resins and the charge controlling agent for use in the continuous phase, the resin for use in the disperse phase, and the average volume of each of the finely-divided disperse phases were changed as shown in Table 2, so that toners No. 16 to No. 23 according to the present invention were obtained.

Each of the thus obtained toners No. 16 to No. 23 according to the present invention was mixed with the same carrier as employed in Example 1, so that a two-component-type developer was obtained in the same manner as in Example 1.

The thus obtained comparative toner No. 2 was mixed with the same carrier as employed in Example 1, so that a two-component-type developer was obtained

TABLE 2

| Toner | Disperse Phase (Mw; Parts by weight) | Continuous Phase (Mw; Parts by weight) | Average Volume of Each of Finely-divided Disperse Phases ($\mu m^3$) | Releasing Agent (Mn; Parts by weight) | Charge Controlling Agent |
|---|---|---|---|---|---|
| Ex. 16 | Styrene - methyl acrylate copolymer (90,000; 20) | Polyester resin (12,000; 30) and styrene - methyl acrylate copolymer (350,000; 45) | 35 | Polypropylene (5,500; 5) | Quaternary-ammonium-salt-containing Copolymer* |
| Ex. 17 | Styrene - methyl acrylate copolymer (90,000; 20) | Polyester resin (12,000; 30) and styrene - methyl n-butyl methacrylate copolymer (200,000; 45) | 35 | Polypropylene (5,500; 5) | Same as above |
| Ex. 18 | Styrene - n-butyl methacrylate copolymer (200,000; 20) | Polyester resin (12,000; 30) and styrene - n-butyl methacrylate copolymer (300,000; 45) | 180 | Polypropylene (5,500; 5) | Amino-group-containing Copolymer** |
| Ex. 19 | Styrene - n-butyl methacrylate copolymer (200,000; 20) | Polyester resin (12,000; 30) and styrene - n-butyl methacrylate copolymer (300,000; 45) | 180 | Polypropylene (25,000; 5) | Same as above |
| Ex. 20 | Styrene - n-butyl methacrylate copolymer (200,000; 20) | Polyester resin (12,000; 30) and styrene - n-butyl methacrylate copolymer (300,000; 45) | 65 | Polyethylene (1,000; 5) | Quaternary-annonium-salt-containing Copolymer* |
| Ex. 21 | Styrene - methyl acrylate copolymer (90,000; 20) | Polyester resin (12,000; 30) and styrene - methyl acrylate copolymer (350,000; 45) | 600 | Polyethylene (1,000; 5) | Same as above |
| Ex. 22 | Styrene - methyl acrylate copolymer (90,000; 20) | Polyester resin (12,000; 30) and styrene - methyl acrylate copolymer (350,000; 45) | 10 | Polypropylene (1,000; 5) | Amino-group-containing Copolymer** |
| Ex. 23 | Polyester resin (20,000; 20) | Styrene - n-butyl methacrylate (150,000; 30) and styrene - n-butyl methacrylate copolymer (200,000; 45) | 10 | Polypropylene (5,500; 5) | Same as above |

*The quaternary-ammonium-salt-containing copolymer was the same as employed in Example 15.
**The amino-group-containing copolymer was represented by the following formula:

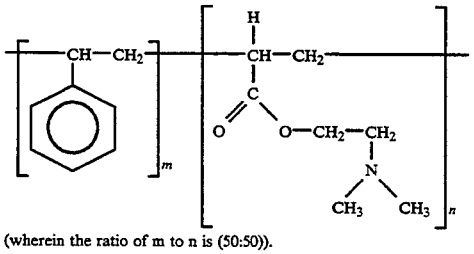

(wherein the ratio of m to n is (50:50)).

Comparative Example 2

A mixture of the following components was kneaded under the application of heat thereto in a two-roll mill for one hour.

| | Parts by weight |
|---|---|
| Styrene - n-butyl methacrylate copolymer (Mw = 200,000) | 43 |
| Polyester resin (Mw = 12,000) | 40 |
| Low-molecular-weight polyethylene (Mw = 3,000) | 5 |
| Carbon black | 10 |
| Quaternary-ammonium-salt-containing copolymer (the same as employed in Example 15) | 2 |

The thus obtained mixture was pulverized and classified, so that a comparative toner No. 2 with a volume mean diameter of 10 $\mu m$ was obtained.

in the same manner as in Example 1.

Each of the above obtained toners No. 1 to No. 23 according to the present invention and comparative toners No. 1 and No. 2 was evaluated with respect to the following items. The results are shown in Table 3.

(1) Staining properties of toner to vinyl chloride film

The making of a print of an image sample was carried out using a commercially available electrophotographic copying machine "FT-4820" (Trademark), made by Ricoh Company, Ltd., supplied with each of the above-obtained developers. The above-mentioned image sample was provided with a 10 mm×50 mm black solid area therein having a reflection density of 1.2.

The thus obtained printed material was interposed between two flexible vinyl chloride films, with the application of a load of 1 Kg per area of A-4 size, and taken out after allowed to stand at 40° C. for 72 hours.

The reflection density of the surface of the vinyl chloride film which was in contact with the printed surface of the printed material was measured with a Macbeth densitometer at a portion corresponding to the black solid area of the printed material, and a portion corresponding to a non-image area thereof. The staining properties of each toner to a vinyl chloride film was expressed by the difference between the above-mentioned two reflection densities. When the vinyl chloride film was not stained with the toner, the staining properties of the toner to the vinyl chloride film was expressed by "0".

(2) Lower limit temperature for image fixing and off-set occurrence temperature

The lower limit temperature for the image fixing and the off-set occurrence temperature were obtained while image formation was carried out using the previously mentioned electrophotographic copying machine "FT-4820" supplied with each developer, with the image fixing temperature thereof varied from 120° C. to 240° C.

(3) Spent phenomenon

A mixture of 3 parts by weight of each toner and 97 parts by weight of iron oxide carrier with an average particle diameter of 100 μm was put in a 100 ml stainless steel pot, and continuously stirred for 24 hours. Thereafter, the toner was blown off the above mixture, and the weight ($W_1$) of the remaining carrier was measured. The above carrier was put in toluene to dissolve the fused toner attached to the carrier therein, so that the toner was completely removed from the carrier. After the carrier was dried, the weight ($W_2$) of the carrier was measured. The degree of the spent toner was expressed by the percentage calculated in accordance with the following formula.

$$\text{Spent phenomenon (\%)} = \frac{W_1 - W_2}{W_1} \times 100$$

(4) Toner deposition on background after making 10,000 copies

After 10,000 copies were made using the previously mentioned electrophotographic copying machine "FT-4820" supplied with each developer, the toner deposition on the background of the image-printed sheet was evaluated by measuring the image density of the background portion of the sheet with a Macbeth densitometer. When there was no toner deposition on the background of the image-printed sheet, the image density of the background was 0.16.

TABLE 3

| | Staining Proper-Properties of Toner to Vinyl Chloride | Lower Limit Temperature for Image Fixing (°C.) | Off-set Occurrence Temperature (°C.) | Spent Phenomenon (%) | Toner Deposition on Background after Making 10,000 Copies |
|---|---|---|---|---|---|
| Ex. 1 | 0.35 | 155 | 225 | 0.075 | 0.22 |
| Ex. 2 | 0.30 | 160 | 200 | 0.030 | 0.20 |
| Ex. 3 | 0.30 | 160 | 210 | 0.045 | 0.18 |
| Ex. 4 | 0.30 | 160 | 215 | 0.098 | 0.18 |
| Ex. 5 | 0.25 | 150 | 240 | 0.025 | 0.18 |
| Ex. 6 | 0.25 | 150 | 235 | 0.028 | 0.18 |
| Ex. 7 | 0.25 | 150 | 220 | 0.020 | 0.18 |
| Ex. 8 | 0 | 155 | 225 | 0.019 | 0.18 |
| Ex. 9 | 0 | 155 | 230 | 0.021 | 0.18 |
| Ex. 10 | 0 | 160 | 240 or more | 0.018 | 0.18 |
| Ex. 11 | 0 | 140 | 235 | 0.020 | 0.18 |
| Ex. 12 | 0 | 145 | 205 | 0.035 | 0.18 |
| Ex. 13 | 0 | 160 | 230 | 0.085 | 0.18 |
| Ex. 14 | 0.20 | 160 | 220 | 0.075 | 0.18 |
| Ex. 15 | 0.35 | 155 | 225 | 0.075 | 0.19 |
| Ex. 16 | 0 | 150 | 230 | 0.020 | 0.17 |
| Ex. 17 | 0.20 | 150 | 230 | 0.020 | 0.17 |
| Ex. 18 | 0.25 | 145 | 240 | 0.028 | 0.17 |
| Ex. 19 | 0.25 | 145 | 190 | 0.028 | 0.17 |
| Ex. 20 | 0.25 | 145 | 235 | 0.025 | 0.17 |
| Ex. 21 | 0 | 155 | 240 or more | 0.098 | 0.17 |
| Ex. 22 | 0 | 155 | 200 | 0.019 | 0.17 |
| Ex. 23 | 0.30 | 150 | 210 | 0.019 | 0.17 |
| Comp. Ex. 1 | 0.90 | 165 | 195 | 0.140 | 0.27 |
| Comp. Ex. 2 | 0.90 | 165 | 195 | 0.140 | 0.25 |

As can be seen from the results in Table 3, the toners of the present invention has high durability and can achieve the image-fixing performance at a low temperature, and at the same time, can prevent the occurrence of the off-set phenomenon. Furthermore, the staining properties of the toner of the present invention with respect to the vinyl chloride product can be remarkably decreased.

What is claimed is:

1. A toner for developing latent electrostatic images, comprising toner particles, each of said toner particles composed of:

(a) a continuous phase comprising a binder resin, and (b) a disperse phase dispersed in the form of finely-divided disperse phases in said continuous phase, comprising (i) a resin which is not the same as said binder resin for use in said continuous phase, and (ii) finely-divided particles of a releasing agent which are dispersed in the resin of the disperse phase, with (c) a coloring agent being dispersed in said continuous phase and/or said disperse phase.

2. The toner for developing latent electrostatic images as claimed in claim 1, wherein the average volume of each of said finely-divided disperse phases is in the range of 2 to 800 $\mu m^3$.

3. The toner for developing latent electrostatic images as claimed in claim 1, wherein said continuous phase further comprises a charge controlling agent.

4. The toner for developing latent electrostatic images as claimed in claim 3, wherein said charge controlling agent is nigrosine.

5. The toner for developing latent electrostatic images as claimed in claim 3, wherein said charge controlling agent is a quaternary-ammonium-salt-containing copolymer.

6. The toner for developing latent electrostatic images as claimed in claim 3, wherein said charge controlling agent is an amino-group-containing copolymer.

7. The toner for developing latent electrostatic images as claimed in claim 1, wherein said binder resin in said continuous phase is selected from the group consisting of a styrene-acrylic acid ester copolymer, a styrene-methacrylic acid ester copolymer, and a polyester resin.

8. The toner for developing latent electrostatic images as claimed in claim 1, wherein said resin in said disperse phase is selected from the group consisting of a styrene-acrylic acid ester copolymer, a styrene-mathacrylic acid ester copolymer, and a polyester resin.

9. The toner for developing latent electrostatic images as claimed in claim 1, wherein said binder resin in said continuous phase is said polyester resin and said resin in said disperse phase is said styrene-acrylic acid ester copolymer, or a styrene-methacrylic acid ester copolymer.

10. The toner for developing latent electrostatic images as claimed in claim 9, wherein said continuous phase further comprises said styrene-acrylic acid ester copolymer or styrene-methacrylic acid ester copolymer.

11. The toner for developing latent electrostatic images as claimed in claim 1, wherein said binder resin in said continuous phase is said styrene-acrylic acid ester copolymer or styrene-methacrylic acid ester copolymer, and said resin in said disperse phase is said polyester resin.

12. The toner for developing latent electrostatic images as claimed in claim 11, wherein said continuous phase further comprises said polyester resin.

13. The toner for developing latent electrostatic images as claimed in claim 9, wherein said styrene-acrylic acid ester copolymer is styrene-methyl acrylate copolymer and said styrene-methacrylic acid ester copolymer is styrene-n-butyl methacrylate copolymer.

14. The toner for developing latent electrostatic images as claimed in claim 11, wherein said styrene-acrylic acid ester copolymer is styrene-methyl acrylate copolymer and said styrene-methacrylic acid ester copolymer is styrene-n-butyl methacrylate copolymer.

15. The toner for developing latent electrostatic images as claimed in claim 2, wherein the average volume of each of said finely-divided disperse phases is in the range of 10 to 800 $\mu m^3$.

16. The toner for developing latent electrostatic images as claimed in claim 15, wherein said binder resin in said continuous phase is styrene-n-butyl methacrylate copolymer; said resin in said disperse phase is said polyester resin; and said releasing agent in said disperse phase is polypropylene or polyethylene.

17. The toner for developing latent electrostatic images as claimed in claim 15, wherein said binder resin in said continuous phase is said polyester resin; said resin in said disperse phase is styrene-n-butyl methacrylate copolymer; and said releasing agent in said disperse phase is polypropylene or polyethylene.

18. The toner for developing latent electrostatic images as claimed in claim 15, wherein said binder resin in said continuous phase is said polyester resin; said resin in said disperse phase is styrene-methyl acrylate copolymer; and said releasing agent in said disperse phase is polypropylene or polyethylene.

19. The toner for developing latent electrostatic images as claimed in claim 1, wherein said releasing agent is polyethylene or polypropylene with a number-average molecular weight of 2,000 to 20,000.

20. The toner for developing latent electrostatic images as claimed in claim 1, the amount ratio by weight of said releasing agent in said disperse phase to said toner is (0.5 to 30): (100).

* * * * *